US011236548B2

(12) United States Patent
Morena

(10) Patent No.: US 11,236,548 B2
(45) Date of Patent: Feb. 1, 2022

(54) LADDER ASSEMBLY HAVING AN INTEGRATED SHOULDER REST

(71) Applicant: John Morena, Mineola, NY (US)

(72) Inventor: John Morena, Mineola, NY (US)

( * ) Notice: Subject to any disclaimer, the term of this patent is extended or adjusted under 35 U.S.C. 154(b) by 291 days.

(21) Appl. No.: 16/443,143

(22) Filed: Jun. 17, 2019

(65) Prior Publication Data

US 2020/0392788 A1 Dec. 17, 2020

(51) Int. Cl.
*E06C 7/08* (2006.01)
*E06C 7/46* (2006.01)
*E06C 1/20* (2006.01)

(52) U.S. Cl.
CPC ..... *E06C 7/08* (2013.01); *E06C 1/20* (2013.01); *E06C 7/46* (2013.01)

(58) Field of Classification Search
CPC ..... E06C 7/08
USPC ..... 182/129; 224/264, 265
See application file for complete search history.

(56) References Cited

U.S. PATENT DOCUMENTS 376,102 A * 1/1888 Miller
4,694,932 A * 9/1987 Schmitt ..... E06C 7/46 182/109
5,005,280 A * 4/1991 Wallick, Jr. ..... E06C 1/16 264/328.8
5,058,789 A 10/1991 Piper
5,207,364 A 5/1993 Johnson
6,189,752 B1 2/2001 Perry
6,685,069 B2 2/2004 Ladd
6,786,371 B2 * 9/2004 Horneman ..... A45F 3/12 182/129
7,789,198 B2 9/2010 Myers
8,322,491 B2 12/2012 Crampton
8,671,542 B2 3/2014 Lanzafame
2002/0046904 A1 * 4/2002 Richard ..... E06C 1/39 182/129
2002/0189902 A1 12/2002 Nelson
2009/0000867 A1 * 1/2009 Wang ..... E06C 7/081 182/104
2018/0163470 A1 * 6/2018 Mora ..... E06C 7/183

FOREIGN PATENT DOCUMENTS

CH 478330 A * 9/1969 ..... E06C 7/08

* cited by examiner

*Primary Examiner* — Alvin C Chin-Shue

(57) ABSTRACT

A ladder assembly having an integrated shoulder rest for facilitating moving of the ladder includes a stepladder that comprises a pair of front rails and a pair of rear rails. Each of a plurality of first cutouts extends arcuately into an inside face of a respective front rail. Each of a plurality of second cutouts extends arcuately into an inner face of a respective rear rail so that the second cutout is aligned with an associated first cutout when the front rails and the rear rails are in a collapsed configuration. The second cutout and the associated first cutout are configured to insert a shoulder of a user, positioning the user to carry the stepladder.

12 Claims, 5 Drawing Sheets

LADDER ASSEMBLY HAVING AN INTEGRATED SHOULDER REST

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ladder assemblies and more particularly pertains to a new ladder assembly for facilitating moving of the ladder.

(2) Description of Related Art Including Information Disclosed Under 37 CFR 1.97 and 1.98

BRIEF SUMMARY OF THE INVENTION

An embodiment of the disclosure meets the needs presented above by generally comprising a stepladder that comprises a pair of front rails and a pair of rear rails. Each of a plurality of first cutouts extends arcuately into an inside face of a respective front rail. Each of a plurality of second cutouts extends arcuately into an inner face of a respective rear rail so that the second cutout is aligned with an associated first cutout when the front rails and the rear rails are in a collapsed configuration. The second cutout and the associated first cutout are configured to insert a shoulder of a user, positioning the user to carry the stepladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
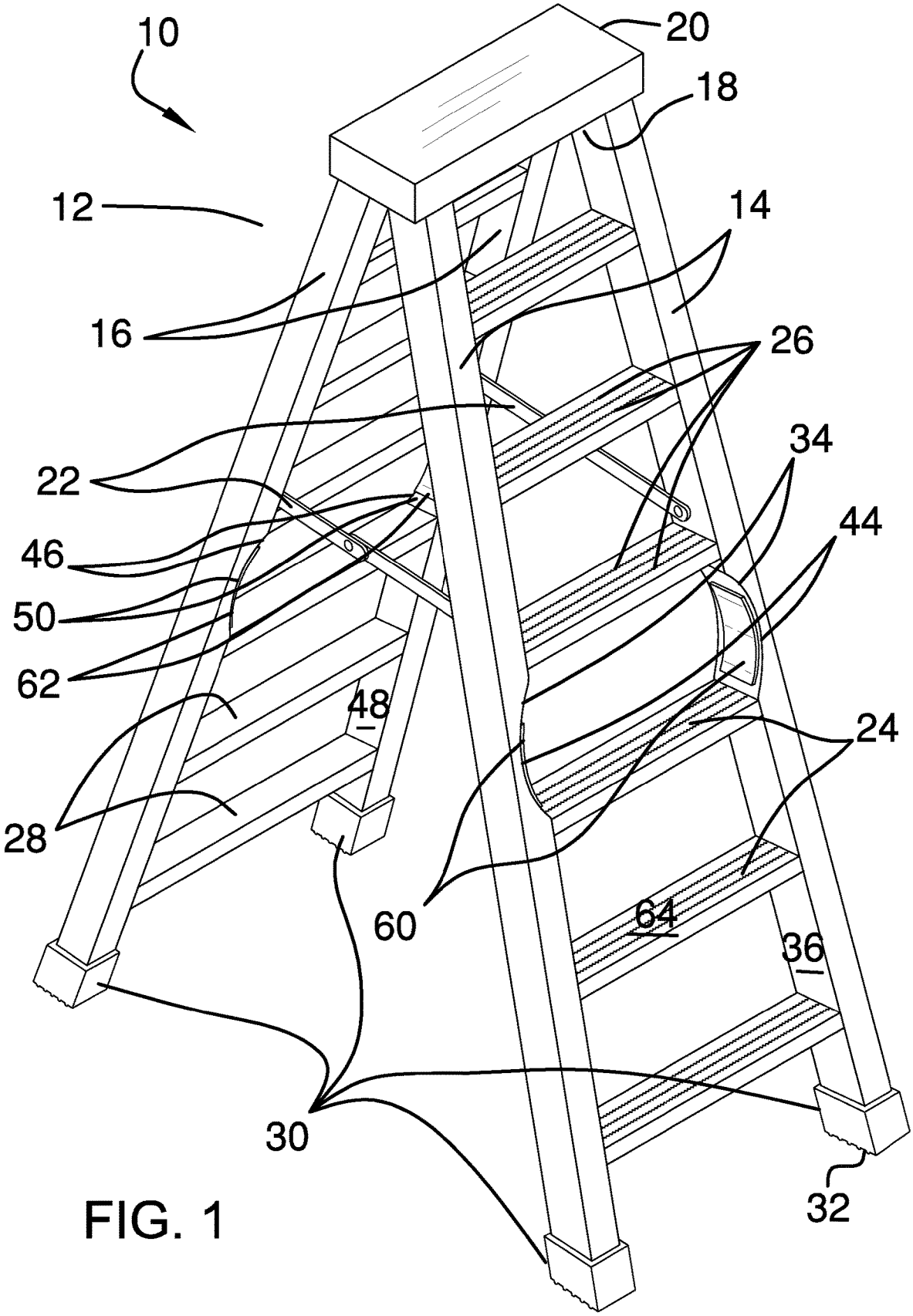
FIG. 1 is an isometric perspective view of a ladder assembly having an integrated shoulder rest according to an embodiment of the disclosure.

With reference now to the drawings, and in particular to FIGS. 1 through 5 thereof, a new ladder assembly embodying the principles and concepts of an embodiment of the disclosure and generally designated by the reference numeral 10 will be described.

As best illustrated in FIGS. 1 through 5, the ladder assembly having an integrated shoulder rest 10 generally comprises a stepladder 12 that comprises a pair of front rails 14 and a pair of rear rails 16. The pair of front rails 14 and the pair of rear rails 16 are hingedly coupled to and extend from a lower face 18 of a top cap 20 of the stepladder 12. A spreader assembly 22 is operationally coupled to and extends between the pair of front rails 14 and the pair of rear rails 16. The spreader assembly 22 is positioned to selectively fixedly position the front rails 14 and the rear rails 16 in an open configuration, wherein the front rails 14 and the rear rails 16 extend transversely from the top cap 20, and a collapsed configuration, wherein the front rails 14 and the rear rails 16 extend perpendicularly from the top cap 20.

Each of a plurality of steps 24 is coupled to and extends between the front rails 14. The steps 24 are configured for a user to ascend and descend the stepladder 12. Each of a plurality of sets of grooves 26 is positioned in an upper face 64 of a respective step 24. The set of grooves 26 is configured to enhance traction of a foot of the user that is positioned on the respective step 24.

Each of a plurality of braces 28 is coupled to and extends between the rear rails 16. The braces 28 are positioned to stabilize the pair of rear rails 16. A set of four feet 30 is coupled singly to the front rails 14 and the rear rails 16 distal from the top cap 20. The feet 30 are configured to stabilize the stepladder 12 on a surface. The feet 30 comprise rubber so that the feet 30 are configured to frictionally couple to the surface. The feet 30 comprise treads 32 so that the feet 30 are configured to frictionally couple to the surface.

Figure 2:
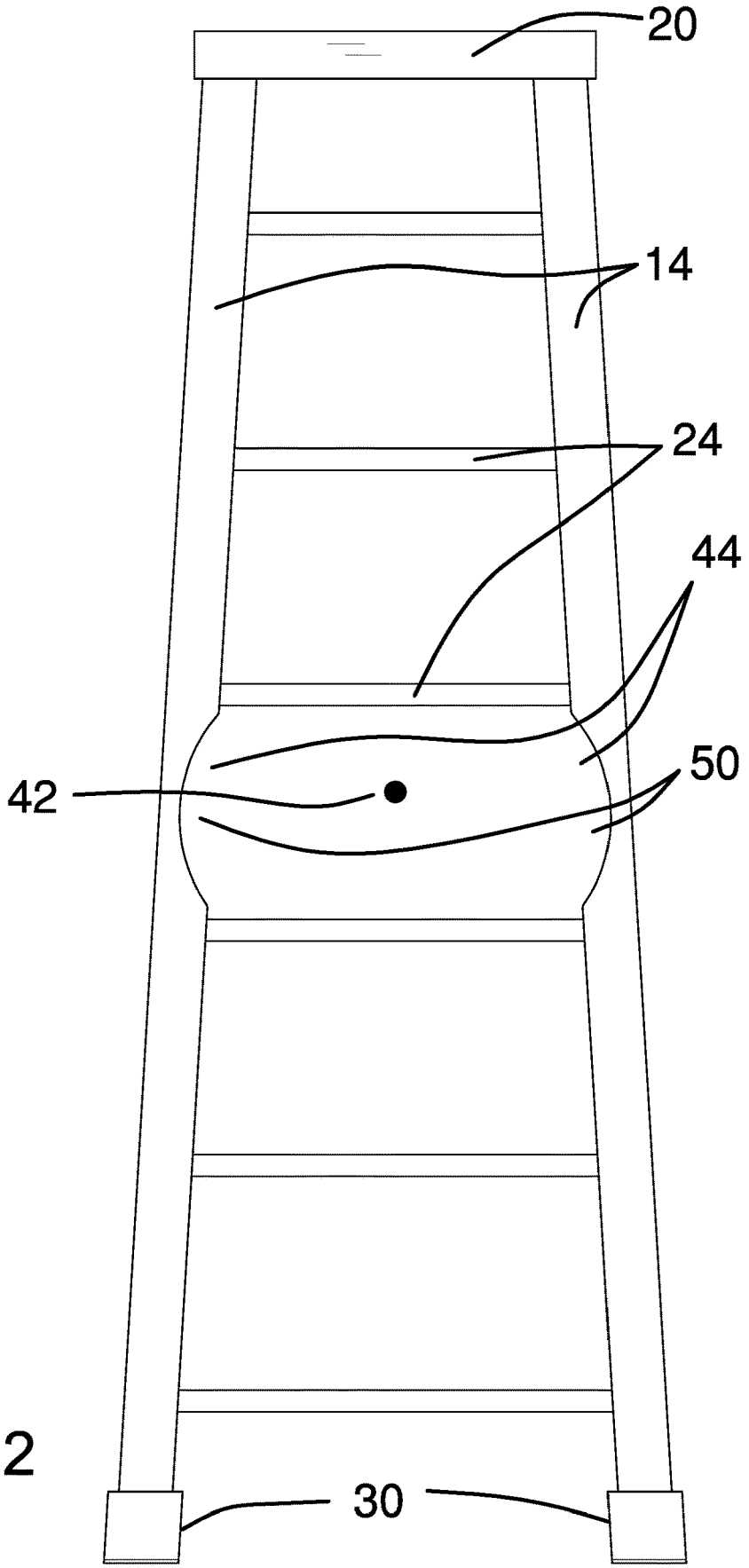
FIG. 2 is a front view of an embodiment of the disclosure.
Figure 3:
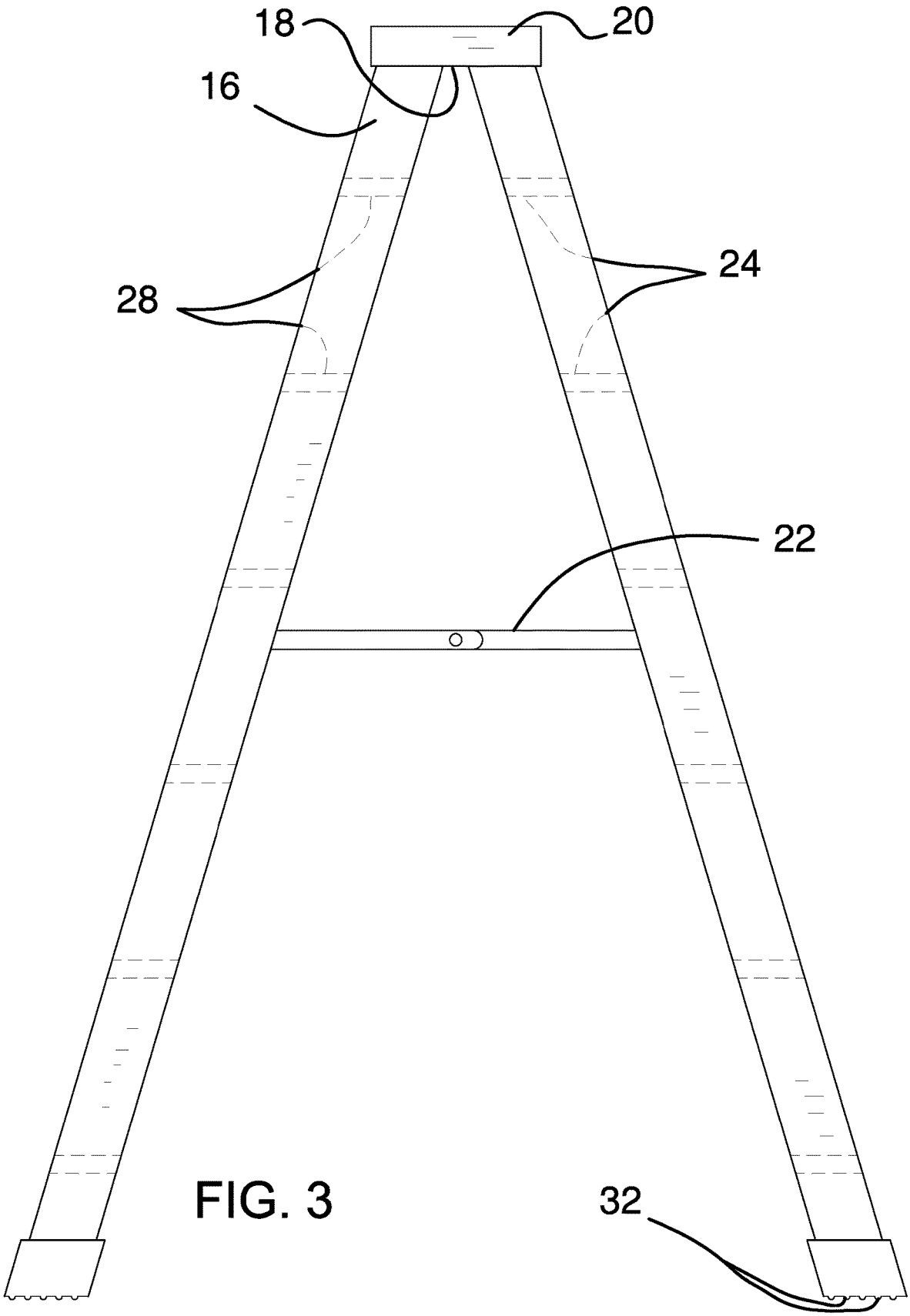
FIG. 3 is a side view of an embodiment of the disclosure.
Figure 4:
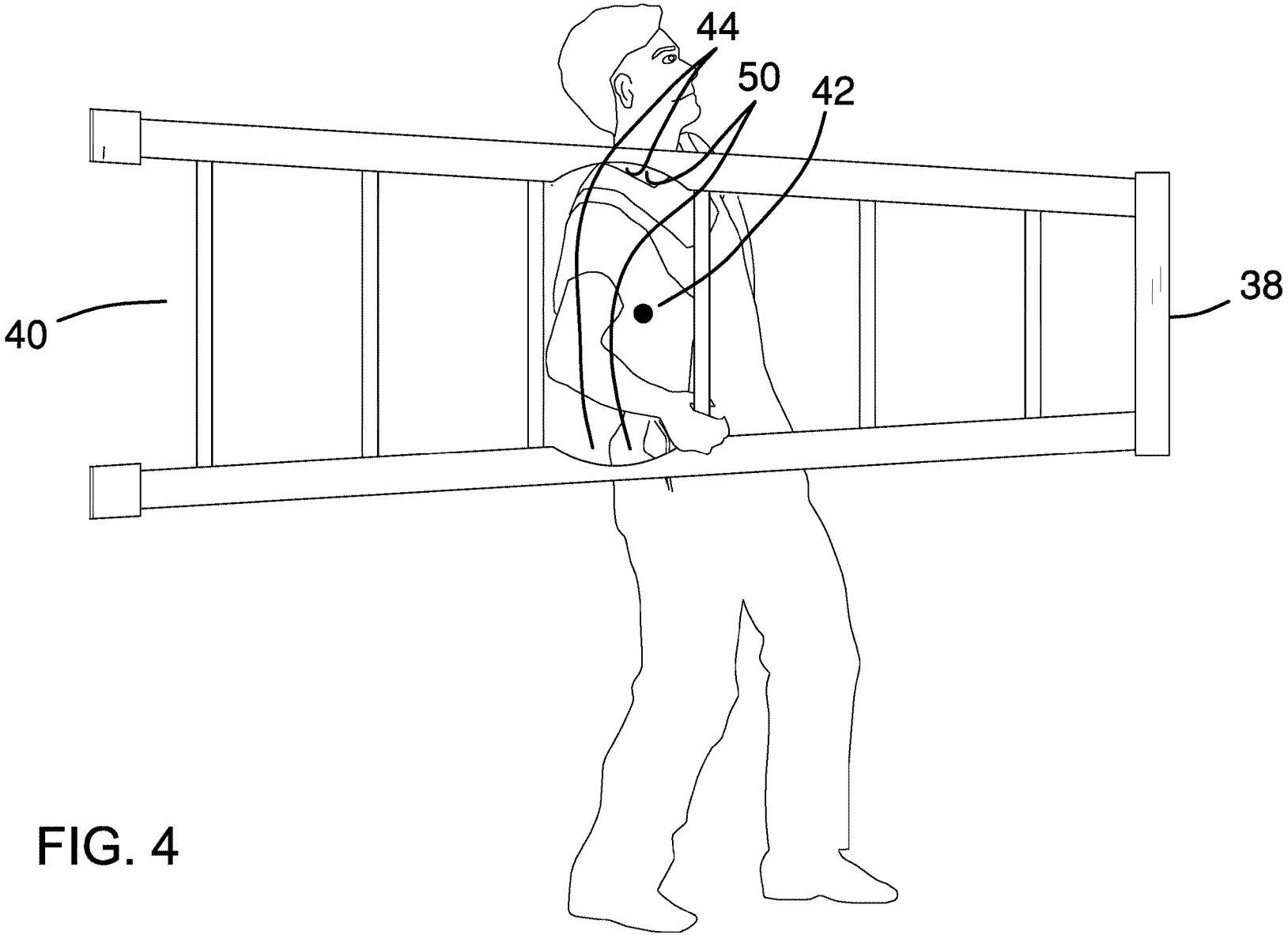
FIG. 4 is an in-use view of an embodiment of the disclosure.

Each of a plurality of first cutouts 34 extends arcuately into an inside face 36 of a respective front rail 14. The plurality of first cutouts 34 may comprise a single first cutout 34 that positioned in a respective front rail 14 substantially equally distant from a top 38 and a bottom 40 of the stepladder 12 so that the first cutout 34 is positioned proximate to a center of mass 42 of the stepladder 12. The plurality of first cutouts 34 also may comprise a center pair of first cutouts 44, as shown in FIG. 2. The center pair of first cutouts 44 is positioned singly in the pair of front rails 14 substantially equally distant from the top 38 and the bottom 40 of the stepladder 12 so that the center pair of first cutouts 44 is positioned proximate to the center of mass 42 of the stepladder 12.

Each of a plurality of second cutouts 46 extends arcuately into an inner face 48 of a respective rear rail 16 so that the second cutout 46 is aligned with an associated first cutout 34 when the front rails 14 and the rear rails 16 are in the collapsed configuration. The second cutout 46 and the associated first cutout 34 are configured to insert a shoulder of a user, positioning the user to carry the stepladder 12. Prior art ladders do not have the first cutout 34 and second cutout 46 extending into the front rail 14 and rear rail 16, respectively, making them uncomfortable to carry on the shoulder of the user.

The plurality of second cutouts 46 may comprise a single second cutout 46 that is positioned in a respective rear rail 16 substantially equally distant from the top 38 and the bottom 40 of the stepladder 12 so that the second cutout 46 is positioned proximate to the center of mass 42 of the stepladder 12, positioning the user to balance the stepladder 12 on a shoulder that is inserted into the second cutout 46 and the first cutout 34.

The plurality of second cutouts 46 comprises a center pair of second cutouts 50 that is positioned singly in the pair of rear rails 16 substantially equally distant from the top 38 and the bottom 40 of the stepladder 12 so that the center pair of second cutouts 50 is positioned proximate to the center of mass 42 of the stepladder 12. The center pair of second cutouts 50 and the center pair of first cutouts 44 prevent the user from having to rotate the ladder on its longitudinal axis to position a respective second cutout 46 and an associated first cutout 34 for inserting the shoulder of the user.

Figure 5:
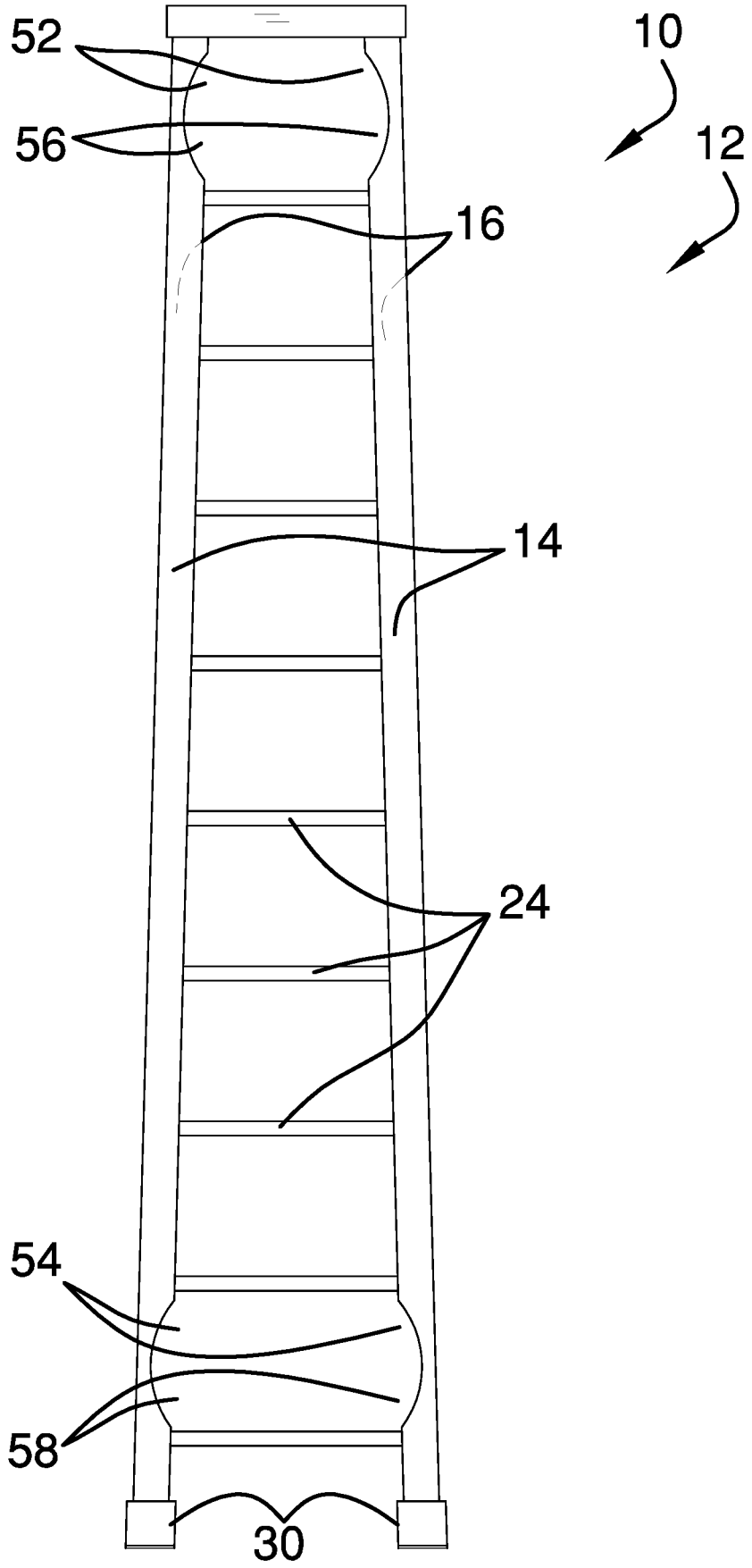
FIG. 5 is a front view of an alternative embodiment of the disclosure.

In another embodiment of the invention, as shown in FIG. 5, the plurality of first cutouts 34 comprises an upper pair of first cutouts 52 that is positioned singly in the pair of front rails 14 proximate to the top 38 and a lower pair of first cutouts 54 that is positioned singly in the pair of front rails 14 proximate to the bottom 40 of the stepladder 12. In this embodiment, the plurality of second cutouts 46 comprises an upper pair of second cutouts 56 that is positioned singly in the pair of rear rails 16 proximate to the top 38 and a lower pair of second cutouts 58 that is positioned singly in the pair of rear rails 16 proximate to the bottom 40 of the stepladder 12. A respective second cutout 56 and an associated first cutout 52 that are positioned proximate to the top 38 of the stepladder 12 are configured to insert a shoulder of a first user. A respective second cutout 58 and an associated first cutout 54 that are positioned proximate to the bottom 40 of the stepladder 12 are configured to insert a shoulder of a second user, positioning the first user and the second user to jointly carry the stepladder 12.

In yet another embodiment of the invention, as shown in FIG. 1, each of a plurality of first pads 60 is coupled to the stepladder 12 and is positioned in a respective first cutout 34. In this embodiment, each of a plurality of second pads 62 is coupled to the stepladder 12 and is positioned in a respective second cutout 46. The second pad 62 and an associated first pad 60 are configured to cushion the stepladder 12 upon the shoulder of the user.

In use, the stepladder 12 is utilized as per prior art ladders. However, when the user is required to move the stepladder 12, the user is positioned to balance the stepladder 12 on the shoulder that is inserted into the second cutout 46 and the first cutout 34 to comfortably transport the stepladder 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder assembly having an integrated shoulder rest comprising:

a stepladder comprising a pair of front rails and a pair of rear rails;

a plurality of first cutouts, each first cutout extending into an inside face of a respective front rail, each first cutout being arcuate extending parallel to a longitudinal axis of the respective front rail, each first cutout being straight extending perpendicular to the longitudinal axis of the respective front rail and fully across the respective front rail; and a plurality of second cutouts, each second cutout extending into an inner face of a respective rear rail such that the second cutout is aligned with an associated first cutout when the front rails and the rear rails are in a collapsed configuration wherein the second cutout and the associated first cutout are configured for inserting a shoulder of a user positioning the user for carrying the stepladder, each second cutout being arcuate extending parallel to a longitudinal axis of the respective rear rail, each second cutout being straight extending perpendicular to the longitudinal axis of the respective rear rail and fully across the respective rear rail.

2. The assembly of claim 1, further including the stepladder comprising:

a top cap, the pair of front rails and the pair of rear rails being hingedly coupled to and extending from a lower face of the top cap;

a spreader assembly operationally coupled to and extending between the pair of front rails and the pair of rear rails wherein the spreader assembly is positioned for selectively fixedly positioning the front rails and the rear rails in an open configuration wherein the front rails and the rear rails extend transversely from the top cap and the collapsed configuration wherein the front rails and the rear rails extend perpendicularly from the top cap; and a plurality of steps, each step being coupled to and extending between the front rails wherein the steps are configured for a user to ascend and descend the stepladder.

3. The assembly of claim 2, further including a plurality of sets of grooves, each set of grooves being positioned in an upper face of a respective step wherein the set of grooves is configured for enhancing traction of a foot of the user positioned on the respective step.

4. The assembly of claim 1, further including a plurality of braces, each brace being coupled to and extending between the rear rails wherein the braces are positioned for stabilizing the pair of rear rails.

5. The assembly of claim 1, further including a set of four feet coupled singly to the front rails and the rear rails distal from the top cap wherein the feet are configured for stabilizing the stepladder on a surface.

6. The assembly of claim 5, further including the feet comprising rubber such that the feet are configured for frictionally coupling to the surface.

7. The assembly of claim 5, further including the feet comprising treads such that the feet are configured for frictionally coupling to the surface.

8. The assembly of claim 1, further including comprising:

the plurality of first cutouts comprising a single first cutout positioned in a respective front rail substantially equally distant from a top and a bottom of the stepladder such that the first cutout is positioned proximate to a center of mass of the stepladder; and the plurality of second cutouts comprising a single second cutout positioned in a respective rear rail substantially equally distant from the top and the bottom of the stepladder such that the second cutout is positioned proximate to the center of mass of the stepladder positioning the user for balancing the stepladder on a shoulder inserted into the second cutout and the first cutout.

9. The assembly of claim 8, further including comprising:

the plurality of first cutouts comprising a center pair of first cutouts positioned singly in the pair of front rails substantially equally distant from the top and the bottom of the stepladder such that the center pair of first cutouts is positioned proximate to the center of mass of the stepladder; and the plurality of second cutouts comprising a center pair of second cutouts positioned singly in the pair of rear rails substantially equally distant from the top and the bottom of the stepladder such that the center pair of second cutouts is positioned proximate to the center of mass of the stepladder.

10. The assembly of claim 1, further comprising:

the plurality of first cutouts comprising an upper pair of first cutouts positioned singly in the pair of front rails proximate to the top and a lower pair of first cutouts positioned singly in the pair of front rails proximate to the bottom of the stepladder; and the plurality of second cutouts comprising an upper pair of second cutouts positioned singly in the pair of rear rails proximate to the top and a lower pair of second cutouts positioned singly in the pair of rear rails proximate to the bottom of the stepladder wherein a respective second cutout and an associated first cutout positioned proximate to the top of the stepladder are configured for inserting a shoulder of a first user and a respective second cutout and an associated first cutout positioned proximate to the bottom of the stepladder are configured for inserting a shoulder of a second user positioning the first user and the second user for jointly carrying the stepladder.

11. The assembly of claim 1, further comprising a plurality of first pads, each first pad being coupled to the stepladder and positioned in a respective first cutout; and a plurality of second pads, each second pad being coupled to the stepladder and positioned in a respective second cutout wherein the second pad and an associated first pad are configured for cushioning the stepladder upon the shoulder of the user.

12. A ladder assembly having an integrated shoulder rest comprising:

a stepladder comprising a pair of front rails and a pair of rear rails, the stepladder comprising:

a top cap, the pair of front rails and the pair of rear rails being hingedly coupled to and extending from a lower face of the top cap, a spreader assembly operationally coupled to and extending between the pair of front rails and the pair of rear rails wherein the spreader assembly is positioned for selectively fixedly positioning the front rails and the rear rails in an open configuration wherein the front rails and the rear rails extend transversely from the top cap and a collapsed configuration wherein the front rails and the rear rails extend perpendicularly from the top cap, a plurality of steps, each step being coupled to and extending between the front rails wherein the steps are configured for a user to ascend and descend the stepladder, a plurality of sets of grooves, each set of grooves being positioned in an upper face of a respective step wherein the set of grooves is configured for enhancing traction of a foot of the user positioned on the respective step, a plurality of braces, each brace being coupled to and extending between the rear rails wherein the braces are positioned for stabilizing the pair of rear rails, and a set of four feet coupled singly to the front rails and the rear rails distal from the top cap wherein the feet are configured for stabilizing the stepladder on a surface, the feet comprising rubber such that the feet are configured for frictionally coupling to the surface, the feet comprising treads such that the feet are configured for frictionally coupling to the surface;

a plurality of first cutouts, each first cutout extending into an inside face of a respective front rail, each first cutout being arcuate extending parallel to a longitudinal axis of the respective front rail, each first cutout being straight extending perpendicular to the longitudinal axis of the respective front rail and fully across the respective front rail, the plurality of first cutouts comprising a single first cutout positioned in a respective front rail substantially equally distant from a top and a bottom of the stepladder such that the first cutout is positioned proximate to a center of mass of the stepladder, the plurality of first cutouts comprising a center pair of first cutouts positioned singly in the pair of front rails substantially equally distant from the top and the bottom of the stepladder such that the center pair of first cutouts is positioned proximate to the center of mass of the stepladder, the plurality of first cutouts comprising an upper pair of first cutouts positioned singly in the pair of front rails proximate to the top and a lower pair of first cutouts positioned singly in the pair of front rails proximate to the bottom of the stepladder;

a plurality of second cutouts, each second cutout extending into an inner face of a respective rear rail such that the second cutout is aligned with an associated first cutout when the front rails and the rear rails are in the collapsed configuration wherein the second cutout and the associated first cutout are configured for inserting a shoulder of a user positioning the user for carrying the stepladder, each second cutout being arcuate extending parallel to a longitudinal axis of the respective rear rail, each second cutout being straight extending perpendicular to the longitudinal axis of the respective rear rail and fully across the respective front rail, the plurality of second cutouts comprising a single second cutout positioned in a respective rear rail substantially equally distant from the top and the bottom of the stepladder such that the second cutout is positioned proximate to the center of mass of the stepladder positioning the user for balancing the stepladder on a shoulder inserted into the second cutout and the first cutout, the plurality of second cutouts comprising a center pair of second cutouts positioned singly in the pair of rear rails substantially equally distant from the top and the bottom of the stepladder such that the center pair of second cutouts is positioned proximate to the center of mass of the stepladder, the plurality of second cutouts comprising an upper pair of second cutouts positioned singly in the pair of rear rails proximate to the top and a lower pair of second cutouts positioned singly in the pair of rear rails proximate to the bottom of the stepladder wherein a respective second cutout and an associated first cutout positioned proximate to the top of the stepladder are configured for inserting a shoulder of a first user and a respective second cutout and an associated first cutout positioned proximate to the bottom of the stepladder are configured for inserting a shoulder of a second user positioning the first user and the second user for jointly carrying the stepladder;

a plurality of first pads, each first pad being coupled to the stepladder and positioned in a respective first cutout; and a plurality of second pads, each second pad being coupled to the stepladder and positioned in a respective second cutout wherein the second pad and an associated first pad are configured for cushioning the stepladder upon the shoulder of the user.

* * * * *